US012766387B2

(12) United States Patent
Marris et al.

(10) Patent No.: US 12,766,387 B2
(45) Date of Patent: Oct. 20, 2026

(54) COMMUNICATIONS AND POWER HUB FOR A SPORTING OBJECT

(71) Applicant: Chip'D Inc., Murrieta, CA (US)

(72) Inventors: Joshua L. Marris, Murrieta, CA (US); Anil K. Agarwal, Rancho Mission Viejo, CA (US); Brandon Pollack, Lake Forest, CA (US); David Hester, Murrieta, CA (US)

(73) Assignee: CHIP'd Inc., Murrieta, CA (US)

( * ) Notice: Subject to any disclaimer, the term of this patent is extended or adjusted under 35 U.S.C. 154(b) by 0 days.

(21) Appl. No.: 19/411,499

(22) Filed: Dec. 8, 2025

(65) Prior Publication Data

US 2026/0306921 A1 Oct. 8, 2026

Related U.S. Application Data

(63) Continuation of application No. 19/169,523, filed on Apr. 3, 2025.

(51) Int. Cl.
*A63B 57/20* (2015.01)
*A63B 24/00* (2006.01)
(Continued)

(52) U.S. Cl.
CPC ..... *A63B 57/20* (2015.10); *A63B 24/0021* (2013.01); *A63B 43/004* (2013.01); *A63B 71/0622* (2013.01); *A63B 2024/0034* (2013.01); *A63B 57/40* (2015.10); *A63B 2071/0647* (2013.01); *A63B 2071/0691* (2013.01);
(Continued)

(58) Field of Classification Search
CPC ... A63B 57/20; A63B 24/0021; A63B 43/004; A63B 71/0622; A63B 57/40; A63B 2024/0034; A63B 2071/0647; A63B 2071/0691; A63B 2220/12;
(Continued)

(56) References Cited

U.S. PATENT DOCUMENTS 7,691,009 B2 * 4/2010 Savarese ..... A63B 37/0003 473/316
2018/0214758 A1 * 8/2018 Mosher ..... A63B 69/3655
2019/0344144 A1 * 11/2019 San Juan ..... A63B 69/00

FOREIGN PATENT DOCUMENTS

AU 2017209538 8/2018
CA 2883098 A1 * 6/2012 ..... A43B 3/34
(Continued)

OTHER PUBLICATIONS

Translation of KR 20120076418 A (Year: 2012).*
Int'l Search Report and Written Opinion Appln No. PCT/US2026/021643 mailed May 15, 2026.

*Primary Examiner* — Jeffrey S Vanderveen
(74) *Attorney, Agent, or Firm* — McAndrews Held & Malloy, Ltd.

(57) ABSTRACT

Systems and methods for a communications and power hub for a sporting object are provided. A power hub includes sensors configured to track one or more parameters corresponding to the sports object, and communications circuitry configured to transmit information to and receive information from devices external to the sports object. The power hub is configured to communicate with the sports object as well as one or more devices external to the sports object. Methods of collecting and displaying data corresponding to parameters measured by the sports object and power hub system are provided.

25 Claims, 13 Drawing Sheets

(51) Int. Cl.
*A63B 43/00* (2006.01)
*A63B 57/40* (2015.01)
*A63B 71/06* (2006.01)

(52) U.S. Cl.
CPC ..... *A63B 2220/12* (2013.01); *A63B 2220/30* (2013.01); *A63B 2220/40* (2013.01); *A63B 2220/833* (2013.01); *A63B 2225/50* (2013.01)

(58) Field of Classification Search
CPC ..... A63B 2220/30; A63B 2220/40; A63B 2220/833; A63B 2225/50
See application file for complete search history.

(56) References Cited

FOREIGN PATENT DOCUMENTS

| | | | | | |
|---|---|---|---|---|---|
| CA | 2865338 | A1 | * | 7/2013 | ..... A63B 60/46 |
| KR | 20120076418 | A | * | 7/2012 | ..... A43B 3/34 |

* cited by examiner

COMMUNICATIONS AND POWER HUB FOR A SPORTING OBJECT

RELATED APPLICATIONS

The present application claims the benefit of, and priority to, and is a continuation of, U.S. patent application Ser. No. 19/169,523, filed Apr. 3, 2025 and titled "Communications and Power Hub for a Sporting Object." The complete subject matter and contents of U.S. patent application Ser. No. 19/169,523 are incorporated herein by reference in its entirety.

BACKGROUND

Systems and methods for communications of sports objects in motion—i.e., objects that are used in various sports-related activities, such as golf balls, soccer balls, basketballs, baseballs, footballs, tennis balls, hockey pucks, lacrosse ball, cricket ball, flying discs, etc.—can be difficult to implement, expensive, and have limited application in many sporting environments. Aside from determining a current location of such a sports object, which is beneficial for activities like golf, a user (or player) may also wish to gather information related to other desired attributes, such as flight path, launch trajectory, object speed, object spin rate, carry distance, and total distance, among others. Thus, there remains a need for a system that provides components capable of monitoring and tracking such a system during a sporting activity.

Aspects of the present disclosure fulfill these needs and provide further related advantages as described in the following summary.

SUMMARY

Aspects of the present disclosure teach certain benefits in construction and use which give rise to the exemplary advantages described below.

Disclosed examples generally relate to systems and methods for tracking a sports object, and, more particularly, to a system for real-time tracking of a sports object that includes a stationary power hub with one or more cradles positioned to receive the sports object to transfer power and/or data, and associated methods of use for monitoring and tracking various attributes associated with the movement of the sports objects.

The disclosed hub systems and methods provide a compact, multi-purpose system, that is advantageously incorporated into a power hub which can also serve as a charging station for a sports object containing similar circuitry. The system employs a variety of transmitting and receiving modalities for communication with the sports object and/or other hubs, resulting in a simple, portable and functional system.

Other features and advantages of aspects of the present disclosure will become apparent from the following more detailed description, taken in conjunction with the accompanying drawings, which illustrate, by way of example, the principles of aspects of the disclosure.

BRIEF DESCRIPTION OF THE DRAWINGS

The accompanying drawings illustrate aspects of the present disclosure.

Figure 1A:
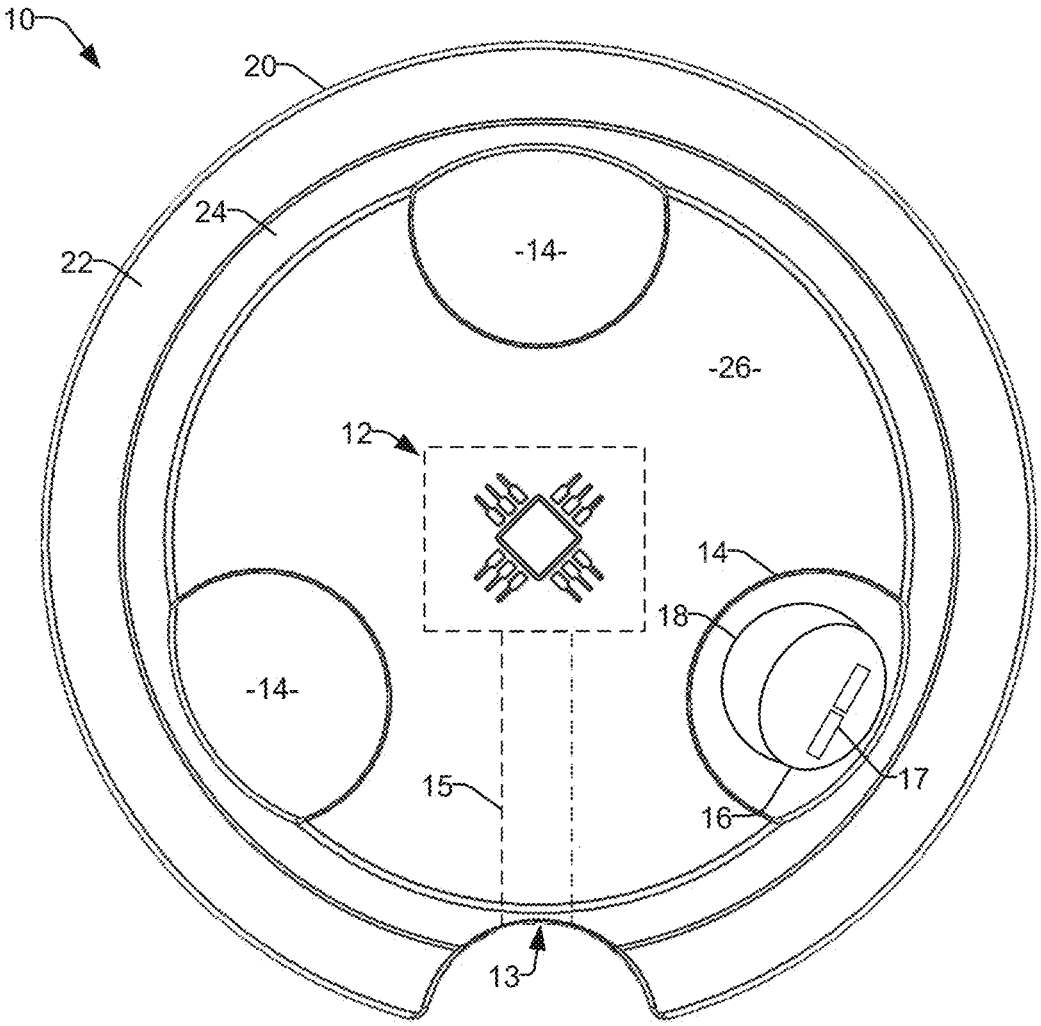
FIGS. 1A through 1F illustrate exemplary hub systems for tracking a sports object, in accordance with aspects of this disclosure.

The above-described drawing figures illustrate aspects of the disclosed subject matter in at least one of the following examples, which are further defined in detail in the following description. The figures are not necessarily to scale. Features, elements, and aspects of the system that are referenced by the same numerals in different figures represent the same, equivalent, or similar features, elements, or aspects, in accordance with one or more examples.

DETAILED DESCRIPTION

Disclosed are systems and methods employing a power and data hub for tracking a sports object. In some examples, a power and data hub includes multiple components to receive and transmit signals corresponding to movement of the sports object, as well as to support operational tracking of the sports object.

Advantageously, the use of a hub in communications with a sports object allows for multiple user applications and communication systems, including data collection, data analytics, user identification, user data repository, performance comparisons, mapping, and data sharing, as a list of non-limiting examples.

In disclosed examples, a system for tracking a sports object including a hub configured to receive a sports object, the hub including: one or more hub sensors configured to track parameters or conditions corresponding to the sports object, and communications circuitry configured to transmit information to and receive information from the sports object and from external devices arranged remote from the hub and the sports object.

In some examples, the communications circuitry includes first and second communications circuitry, the first communications circuitry configured to transmit and receive data via a first protocol or a first power range, and the second communications circuitry configured to transmit and receive data via a second protocol or a second power range.

In some examples, the system further includes a sports object that includes object sensors configured to track one or more parameters corresponding to the sports object, and control and communications circuitry configured to transmit information to and receive information from one or more of the external devices and the hub.

In examples, the hub includes a housing configured to support the hub sensors and the communications circuitry, the housing further configured to removably receive the sports object, and having an outer circumference and external height to all the housing to fit inside a regulation-sized golf hole; and further including one or more antennas, the one or more antennas configured to receive information from and transmit information to the one or more external devices, or the sports object.

In examples, the antennas include two or more removable antennas configured to communicate with each other in a mesh network.

In examples, the mesh network is configured to track the one or more parameters corresponding to the sports object.

In examples, the one or more parameters include velocity, acceleration, or position of the sports object.

In examples, the one or more parameters include a level of energy storage of the sports object.

In examples, the one or more antennas are configured to communicate with each other using ultra-wideband.

In examples, the hub includes a wireless charger configured to charge the sports object when arranged within the housing and with the hub.

In examples, the first communications circuitry is configured to communicate with the sports object, and the second communications circuitry is configured to communicate with a remote computer.

In examples, the remote computer is a smartphone, a mobile computer, or a server.

In examples, the hub includes a cradle configured to removably receive the sports object.

In examples, the one or more parameters include velocity, acceleration, or position of the sports object.

In examples, the cradle includes a coil configured to wirelessly charge the sports object when arranged within the cradle.

In some examples, the first communications circuitry is configured to communicate with the sports object, and the second communications circuitry is configured to communicate with a remote computer.

In examples, the remote computer is a smartphone, a mobile computer, or a server.

In some disclosed examples, a method of collecting and displaying data corresponding to a sports object, the method including collecting data from one or more sensors of a sports object, the data corresponding to one or more parameters corresponding to a position or status of the sports object, and circuitry configured to transmit information to and receive information from devices external to the sports object; transmitting the data from the sports object to the devices external to the sports object; collecting data from a power hub configured to track one or more parameters corresponding to the sports object, and circuitry configured to transmit information to and receive information from the devices external to the sports object; transmitting the data from the power hub to the devices external to the sports object; and displaying one or more parameters corresponding to the data from the sports object or the data from the power hub on the devices external to the sports object.

In some examples, the method further including determining a path along which the sports object moves, and transmitting data corresponding to the path along which the sports object moves to the devices external to the sports object.

In examples, the method further including aggregating data determining the path along which the sports object moves; using the data determining the path along which the sports object moves to virtually recreate a sports object course; and displaying a virtual recreation of the terrain on which the sports object moves on the devices external to the sports object.

In some examples, the method further includes comparing the one or more parameters from the sports object to one or more parameters from hub sensors; and displaying data from the comparison on the devices external to the sports object.

In some examples, the method further includes collecting data corresponding to the same one or more parameters from one or more other sets of sports object and power hubs; comparing the data corresponding to the one or more parameters from one set of sports object and power hubs to the data corresponding to the one or more parameters from the one or more other sets of sports objects and power hubs; and displaying the data corresponding to the comparison on the devices external to the sports object.

Figure 1B:
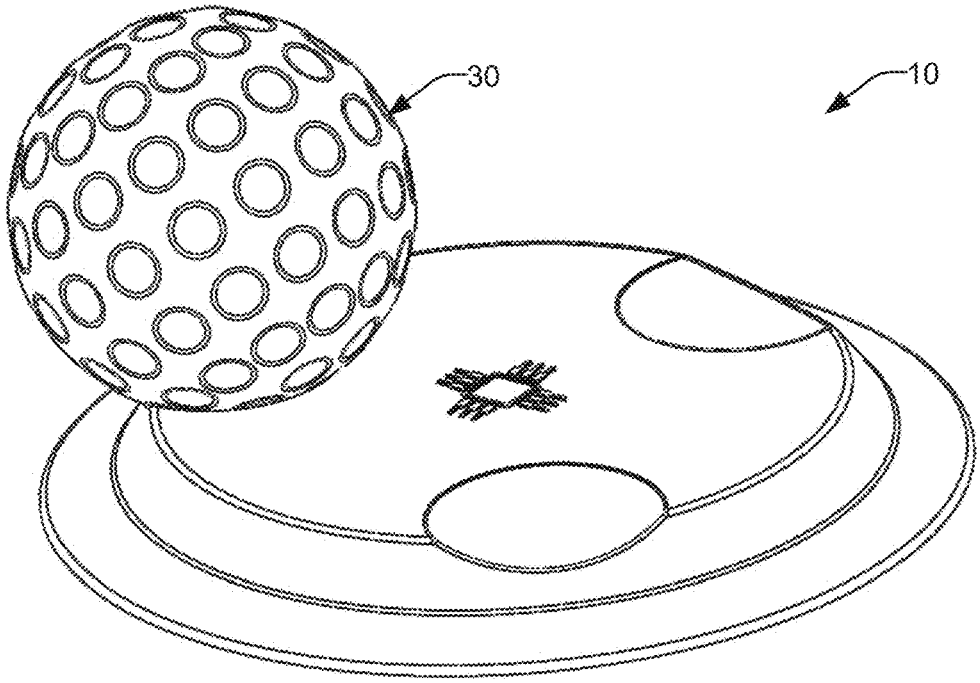
Figure 1C:
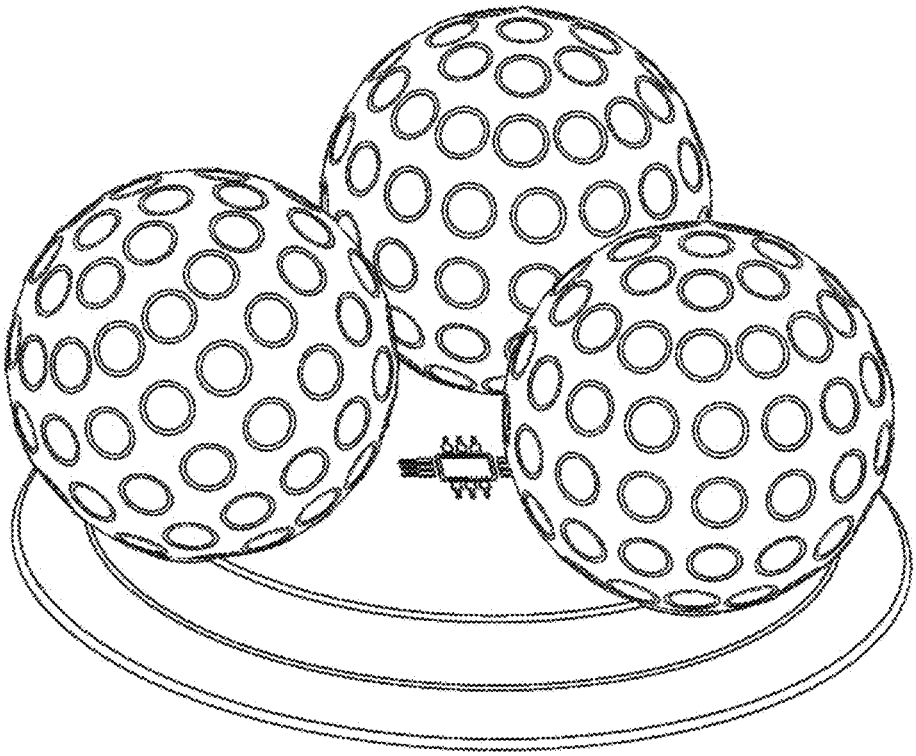
Figure 1D:
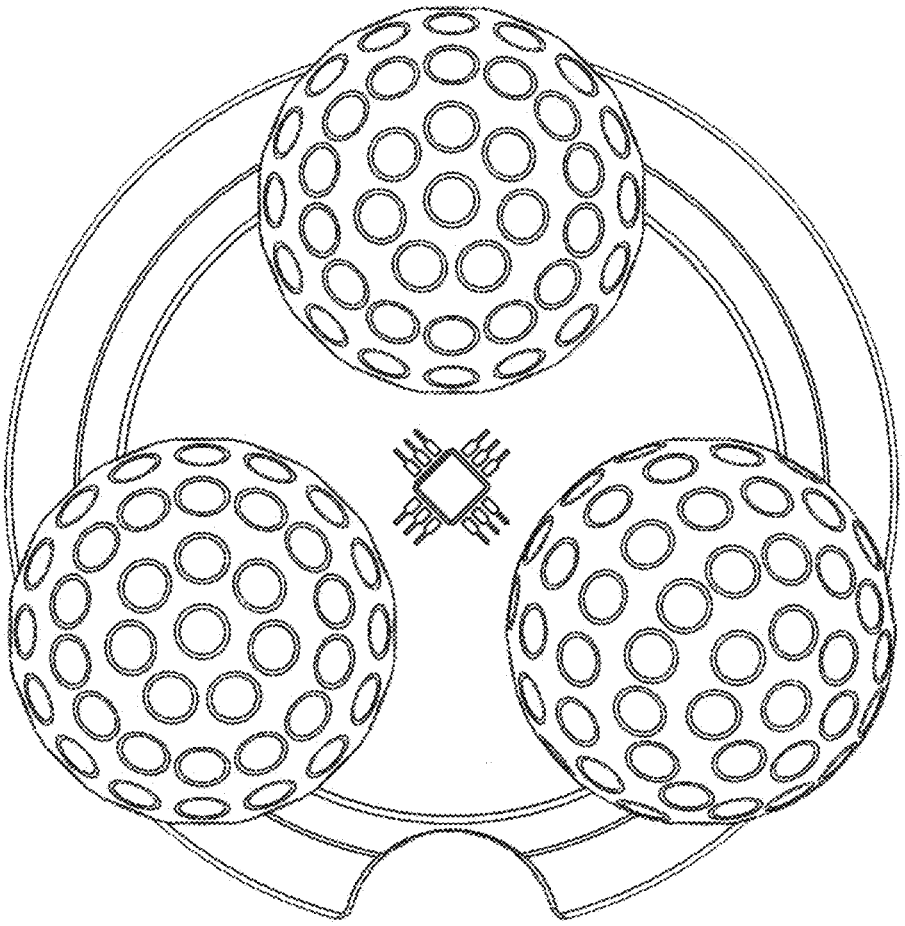
Figure 1E:
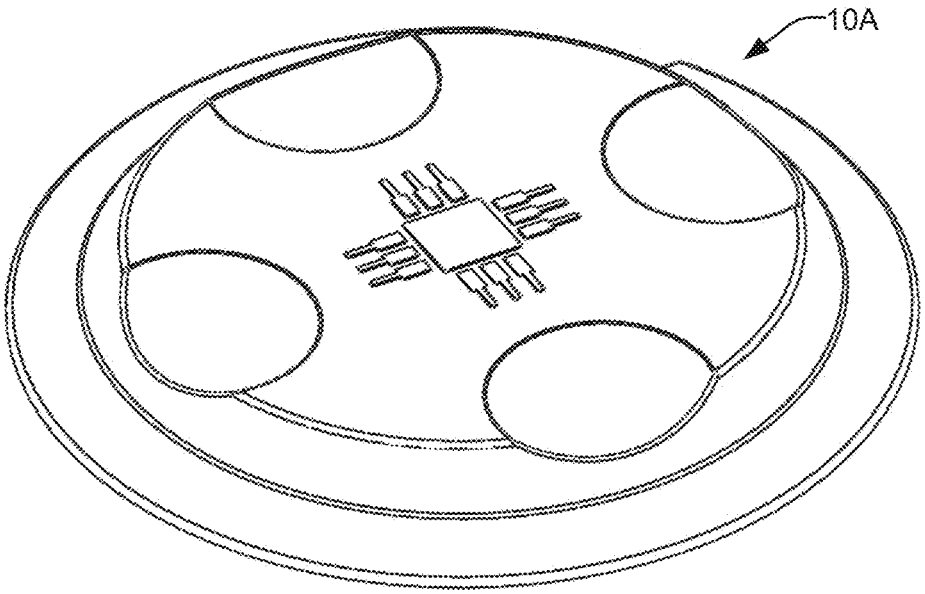

Turning now to the figures, FIGS. 1A through 1E illustrate an exemplary system 10 for tracking a sports object. Particular examples are provided with the example system 10 defining a hub, with a number of cradles 14 capable of receiving and supporting one or more sports objects (e.g., a ball, a golf ball, a puck, etc.). The system may be operated as a standalone device, supportable by any surface (e.g., the ground, a stage, table, etc.) and configured to receive the sports object (as shown in FIGS. 1B to 1D), such as during a putting exercise. In some examples, the system 10 can be placed within and/or be incorporated with a housing or other container (as shown in FIGS. 2A to 2D), such as a golf cup.

As shown in FIG. 1A, the system or hub 10 includes a frame 20, which may have a base 22 to rest upon a surface. An upper surface 26 is raised from the base 22 by inclined portion 24, which creates a space or cradle 14 with a size sufficient to balance the sports object 30, as shown in FIGS. 1B to 1D. The frame 20 of the hub 10 can be formed of a rigid or semi-rigid material, such as Nylon, Polycarbonate (PC), Acrylonitrile butadiene styrene (ABS), Polystyrene (PS), Polymethyl methacrylate (PMMA), Polybutadiene (PB), or other thermoplastic or thermoset material, as a list of non-limiting examples.

On or more cradles 14 can have antennas 16 and 18 arranged within the cradle 14. The antennas can be designed to transmit and/or receive signals from the sports object, or another device. The antennas can also provide or receive inductive power, for the hub to charge the sports object (or, in some examples, for the sports object or another device to charge the hub).

In some examples, the hub 10 includes contacts 17. The contacts 17 can be configured to provide and/or receive power from the energy storage device of the hub (and/or from power delivered via port 13) to charge the sports object 30 (or, in some examples, for the sports object or another device to charge the hub).

The cradles 14 may be configured to accommodate any manner of sports object 30. For example, the cradles 14 may be circular to accommodate round sports objects (e.g., a golf ball, a baseball, etc.). In other examples, the cradles 14 may comprise a crescent or other shape to accommodate a variety of sports objects of different shapes (e.g., a hockey puck, a football, etc.).

In another example, port 13 of the hub 10 may be configured to receive a physical connector for the sports object, designed to send and/or receive power and/or data to the sports object 30. In such examples, the sports object may be configured to receive a connection from the hub 10, and the hub may receive data from the sports object, and/or transfer data to the sports object. The hub may provide or receive power from the sporting object (i.e., charging either the sporting object or the hub) while the physical connector is connected to the sporting object via the port. This feature is used to accommodate sports objects with a size and/or shape that may not directly fit within a cradle of the hub.

In some examples, the hub includes, and/or may be used to support, a sports object platform. The platform is configured to have a physical connection to the hub 10 and support a sports object for the purposes of charging and/or the transfer of data between the sports object and the hub. The platform is configured to support the sports object, creating a space sufficient to balance the sports object, similar to the examples shown in FIGS. 1B and 1D. The platform may be connected to the hub via a physical cable connected to a port 13, or the platform may connect to the hub via another means (e.g., via a physical connection to cradles 14). The platform may further contain contacts (such as contacts 17) to form a physical connection with the sports object. The platform may be configured to house a larger sports object (e.g., a football, soccer ball, basketball, etc.), allowing a connection to be made between the hub and sports object beyond inductive power and/or near field communication.

In some examples, the hub 10 includes an energy storage device 24 such as a rechargeable energy storage device (e.g., a Lithium-ion battery). One of the antenna can be configured as an induction coil to receive a wireless signal to generate a current to charge the energy storage device and/or transfer power to the object. The induction coil can be arranged on a surface of the cradle 14 (internal or external), to be within close proximity to an object within the cradle. For example, the induction coil can be printed or otherwise arranged on a separate section and indexed to ensure alignment with a transmitter coil in a corresponding charger (not shown).

In some examples, the induction coil and/or antenna are arranged in, on or about the cradle 14, with the capacity to transmit and/or receive in various formats/spectra, and can be multiplexed or frequency split to isolate any associated signals if they are operating concurrently.

For example, antennas of the one or more of the cradles 14 can form a phased array antenna, resulting in an improved receiver as well as enhanced structural support. In some examples, the antennas may include one or more of an ultra-wide band (UWB) antenna, a blue tooth antenna, or a global navigation satellite system (GNSS) antenna or a NFC antenna, as a list of non-limiting examples. For instance, a UWB can be employed as a baseband receiver to enable sub-centimeter location accuracy as the object is hit and approaches a target (e.g., within a confined indoor or outdoor, monitored area such as a putting green).

The antennas 16 and 8 are in electrical communication with a controller 12, which can house components can be selected from one or more of a GNSS receiver, a haptic controller, a temperature sensor, a processor, a memory storage device, an energy storage device, a BT low energy baseband controller, UWB baseband controller, a NFC controller, an energy contact, an antenna contact, an antenna, or an induction coil, as a list of non-limiting examples. The components can be arranged on a printed circuit board and/or be arranged within the hub 10 and connected via physical means (wired, contacts, traces, etc.) and/or via wireless means. In some examples, a port 13 is configured to receive a physical connector to receive data and/or power from an external device.

FIG. 1B illustrates a sports object supported within a cradle 14 of the hub 10. As shown, a rounded portion of an outer surface of an example golf ball is mated with a concave portion of the cradle 14, such that the ball is mounted, supported, or otherwise balanced within the cradle. In this manner, the ball retains a fixed position within the cradle, allowing transfer of data and/or power between the hub and the object. In some examples, magnets can be arranged in the hub and the object to ensure alignment and placement of the object within the hub.

In the examples shown in FIGS. 1A to 1D and 1F, the hub is designed to support three objects (e.g., golf balls). In the example shown in FIG. 1E, hub 10A includes four cradles 14, configured to support four objects/balls. Although examples hubs are illustrated with three and four cradles, in some examples, a hub can include a single cradle, two cradles, five, six, seven, eight, nine, and/or 10 cradles, as a list of non-limiting examples.

Figure 1F:
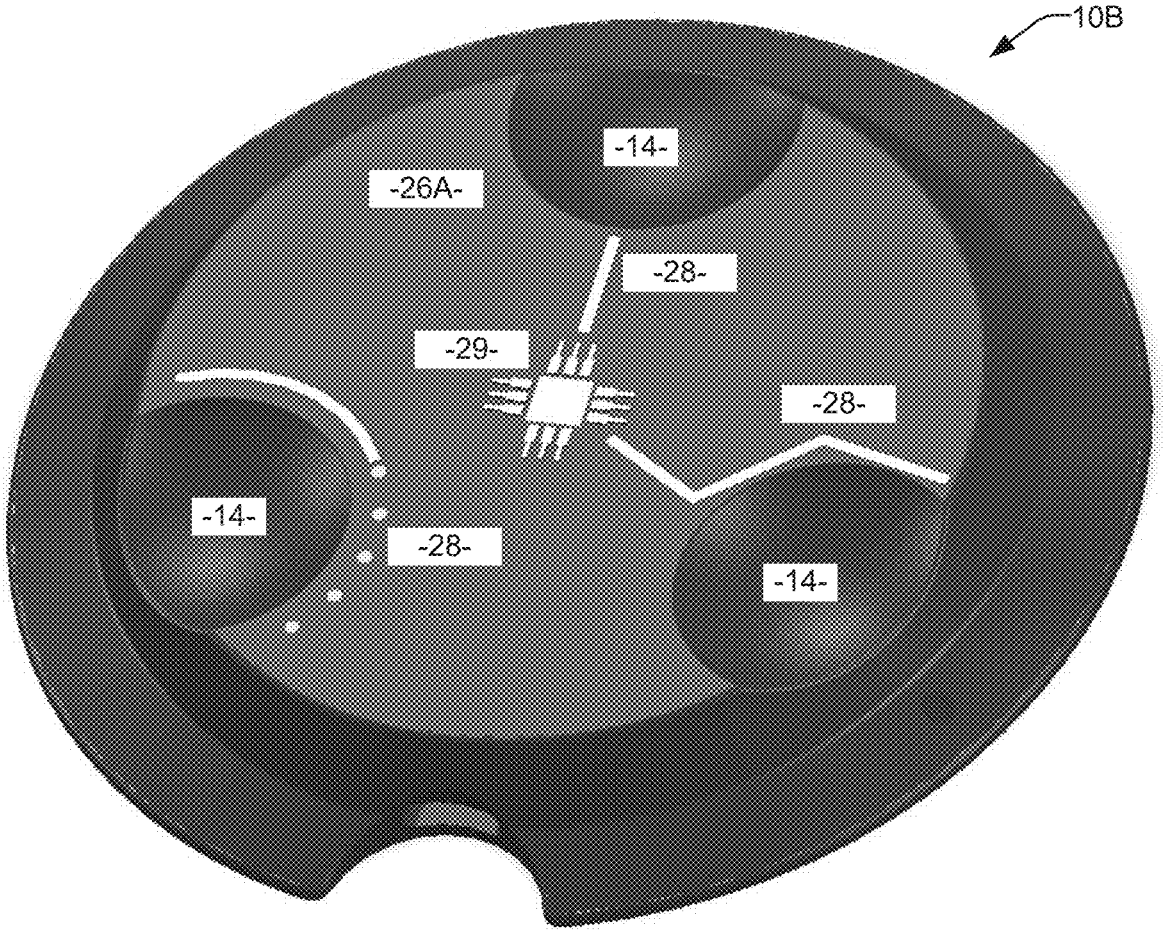

Example FIG. 1F illustrates a hub 10B where surface 26A serves as a user interface, displaying static and/or dynamic indicators representing one or more conditions of the hub or the objection, and/or actions of the hub. For example, indicator 29 can represent activity (e.g., that the hub is receiving power, communications from an object/hub/remote device, updates, etc.) and/or a status (e.g., low power, a connectivity error, etc.). Indicators 28 can provide information regarding a specific cradle, such as when an object sits within the cradle. The indicator 28 can represent transfer of power and/or data, a status of the object (e.g., battery status, charging status, memory status, object name, etc.). The indicators therefore provide a visual representation of the activities and/or status of the hub and associated objects.

Although some examples of the disclosed sports object are illustrated as a golf ball, the core assembly and tracking system can be used as a core for a variety of sporting objects, such as baseballs, softballs, cricket balls, lacrosse balls, field hockey balls, and ice hockey pucks, as a list of non-limiting examples. Furthermore, Turning to FIGS. 2A and 2B, another example hub 50 to receive a sports object is provided. In some examples, hub 50 includes a housing 52 to support a controller 12A (similar to controller 12). In examples, a lower portion 54 can be separated from an opening/cavity 51 of the hub, which can contain the controller 12A. Thus, when an object/ball is received through the opening 51, it may come to rest on a top surface of the lower portion 54 without coming into contact with controller 12A or associated components. In some examples, an antenna 56 can be arranged at an upper portion of the housing to facilitate communications with distant objections.

In some example, the hub 50 is designed to replace a golf cup, such that a conventional golf cup can be removed (from a putting green, practice green, etc.) and the smart hub 50 can be inserted into the space. The external dimensions of the hub 50 are therefore similar to that of a regulation golf cup (in the example of FIG. 2A, several millimeters in diameter, but the disclosed concepts are not so limited). When employed on a putting green, an optional slot 58 can be arranged the lower portion 54. The slot 58 can be designed to receive a flag pole 66, which is then supported by the hub 50. To the golfer, the hub 50 appears as a conventional arrangement, and operates in a similar matter, while the desired movement and positional information of the ball is collected.

In some examples, the slot 58 includes one or more contacts 62 to mate with contacts 64 on the pole 66. In an optional example, the flag pole 66 includes one or more antenna, which expand the reception and/or transmission capabilities of the hub 50.

Figure 2A:
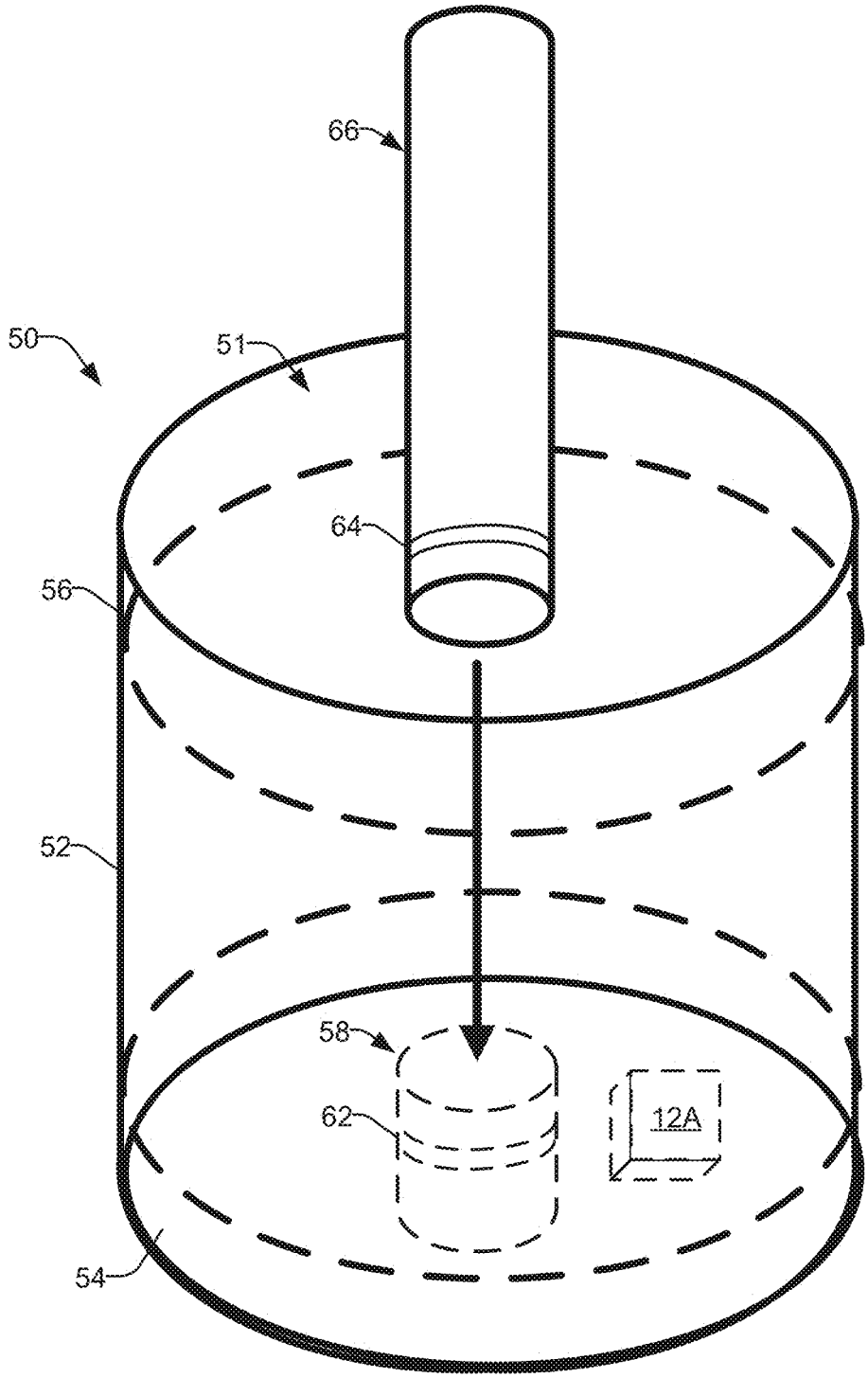
FIGS. 2A and 2B illustrate exemplary cup style hub systems for tracking a sports object, in accordance with aspects of this disclosure.
Figure 2B:
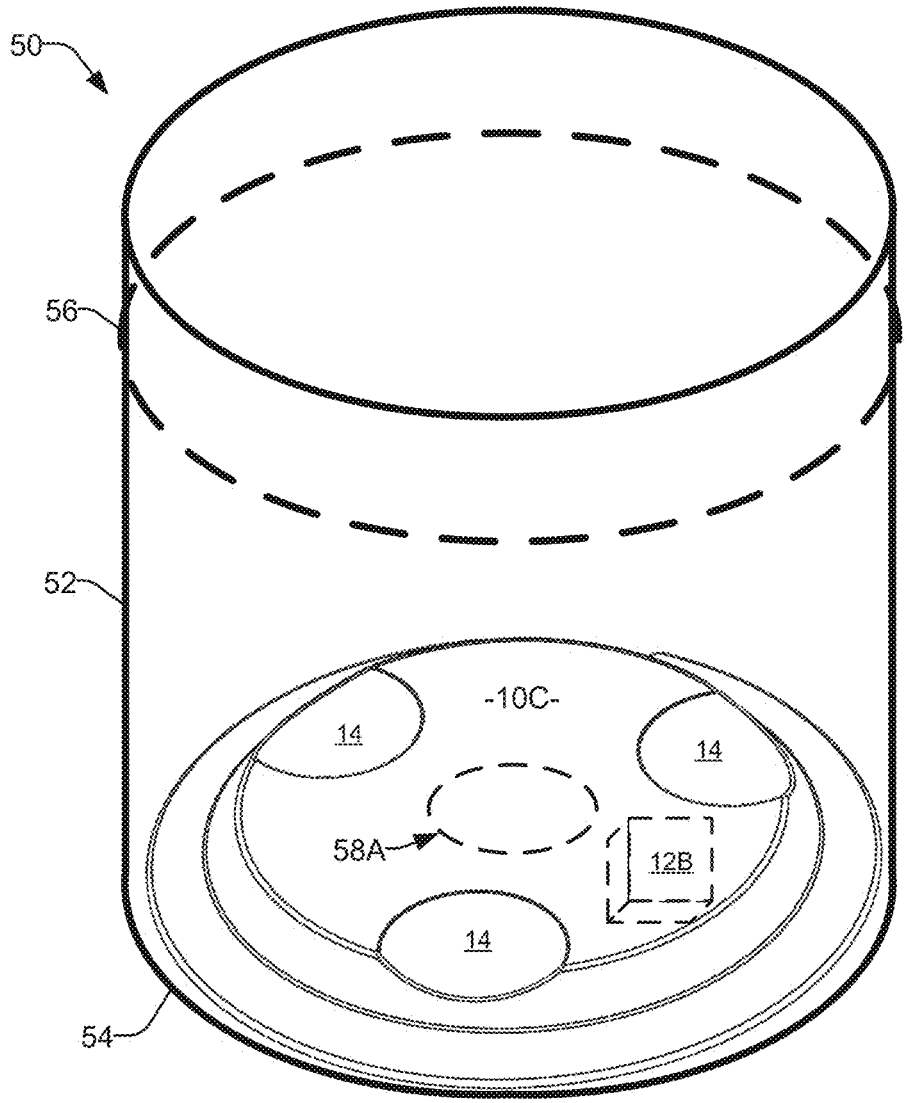

In the example of FIG. 2B, a hub 10C, similar to hub 10, is placed within the housing 52 of hub 50. As shown, the hub 10C includes a number of cradles 14, and is complete with controller 12B (similar to controller 12 and 12A). Optionally, hub 10C can include a slot 58A to receive a flag pole, as described with respect to FIG. 2A. The hub 10C may be dimensioned to fit within a bottom surface of the housing 52, and can be removably inserted during play, later removed for recharging, downloading data, repair, etc.

Figure 3:
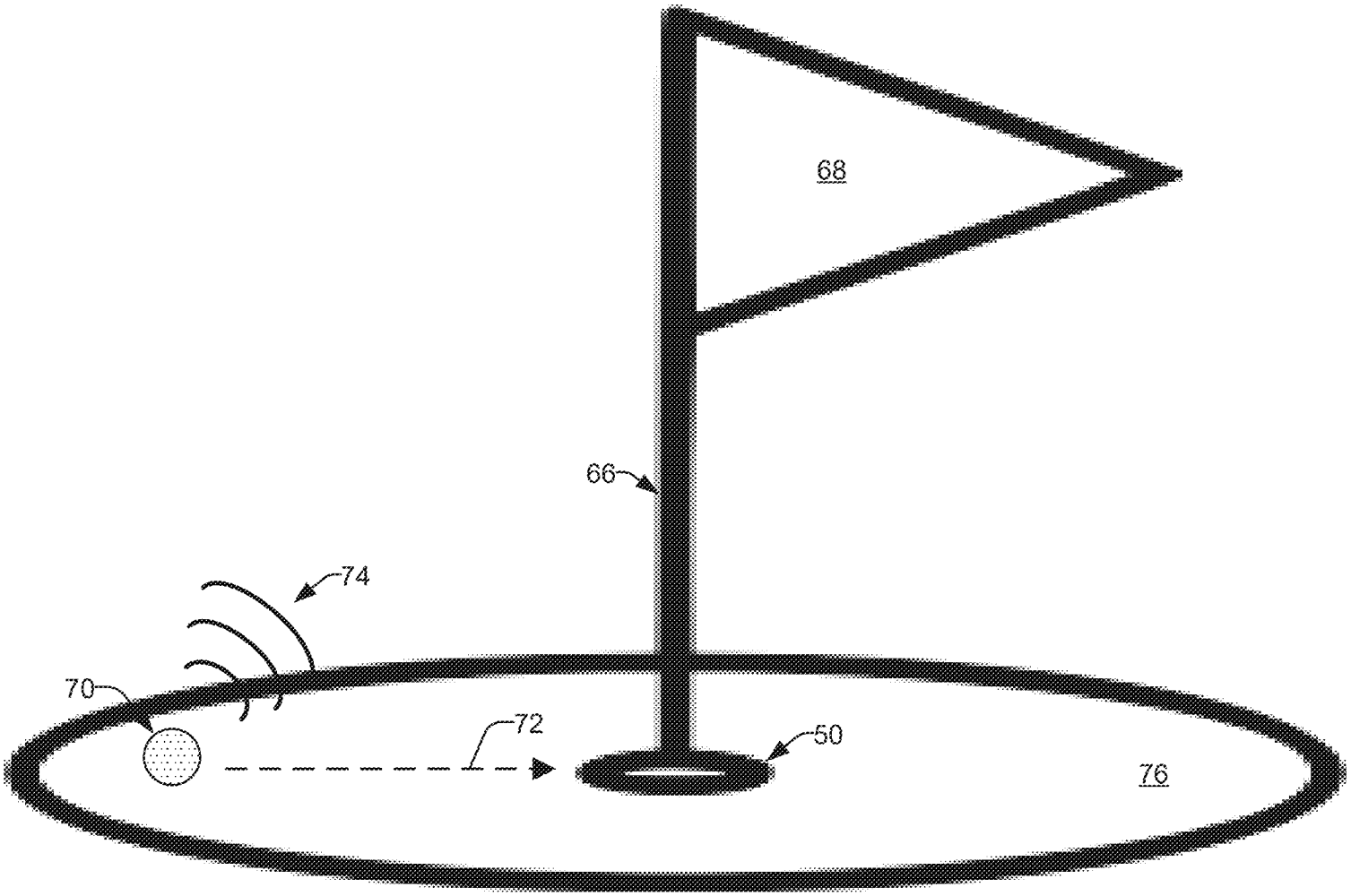
FIG. 3 illustrates an exemplary putting environment employing an example hub system, in accordance with aspects of this disclosure.

FIG. 3 illustrates a putting green 76 utilizing the hub 50. As shown, the hub 50 supports flag pole 66 (within slot 58). The flag pole 66 can include an antenna, and/or antenna can be arranged in flag 68 itself. In some examples, the flag 68 additionally or alternatively includes solar paneling to recharge batteries of the hub 50.

During play, a sports object 70 is hit towards the hub 50 along path 72. The communications circuitry within the object transmits signals 74 toward the hub 50 and/or the flag/flagpole 68/66, providing information corresponding to real-time location and/or motion tracking, including distance from the hub, position of the object as it travels along the path, and/or speed, as a list of non-limiting examples. The information can be used to create a topological map of the green 76.

Figure 4:
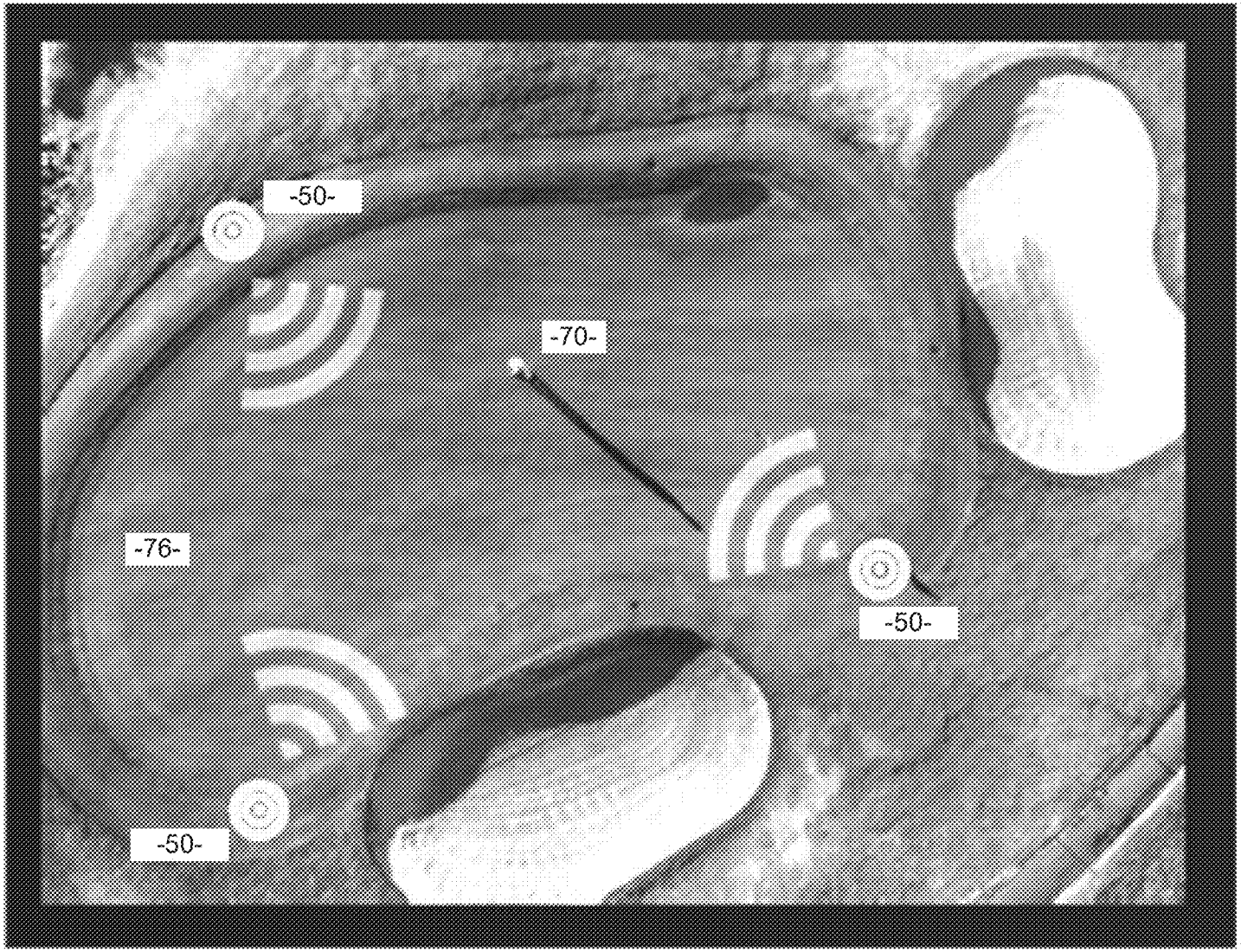
FIG. 4 illustrates a top view of an exemplary putting environment employing an example hub system, in accordance with aspects of this disclosure.
Figure 6A:
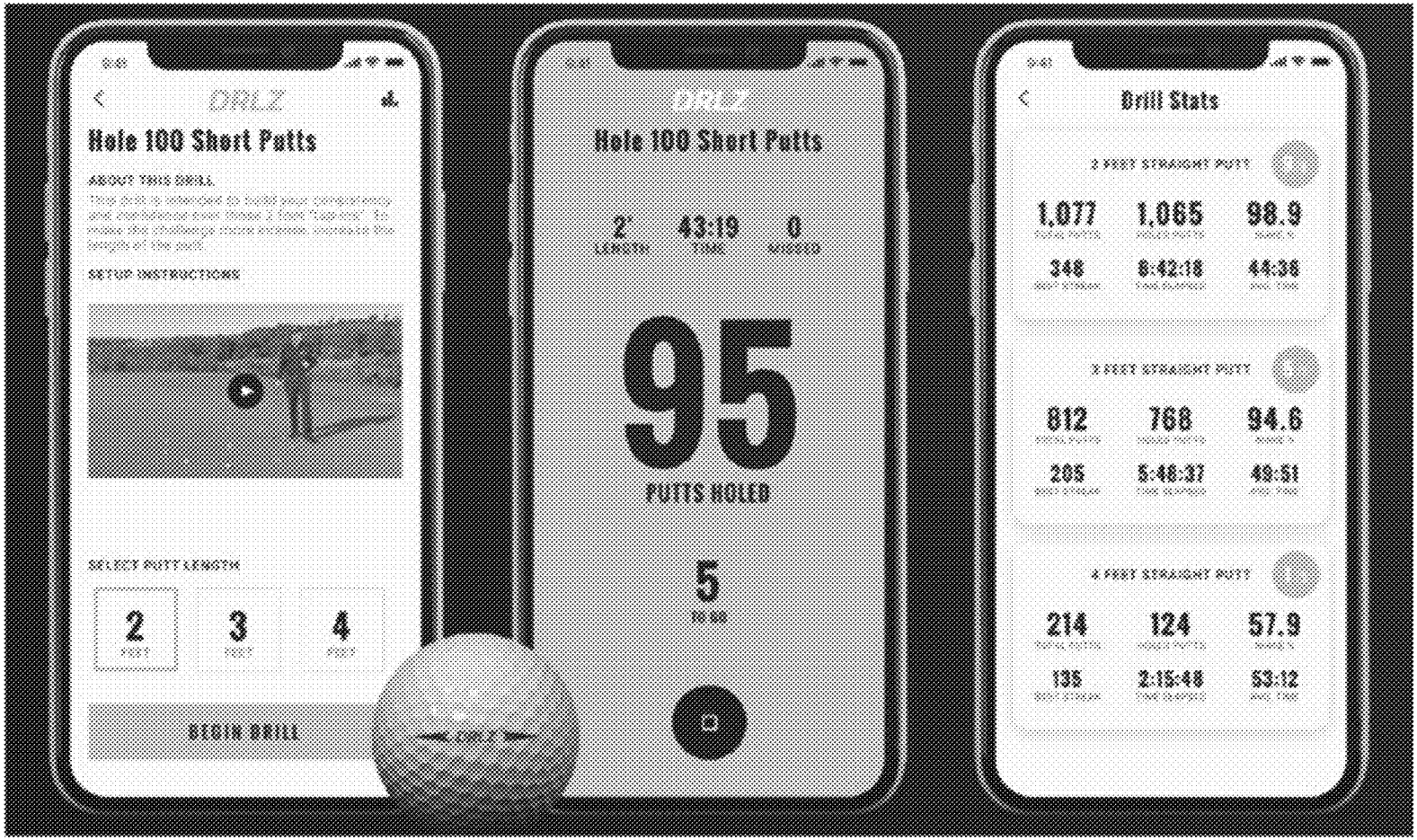
FIGS. 6A through 6C illustrate exemplary views of a display of a performance tracking application informed by an example hub for tracking a sports object, in accordance with aspects of this disclosure.
Figure 6B:
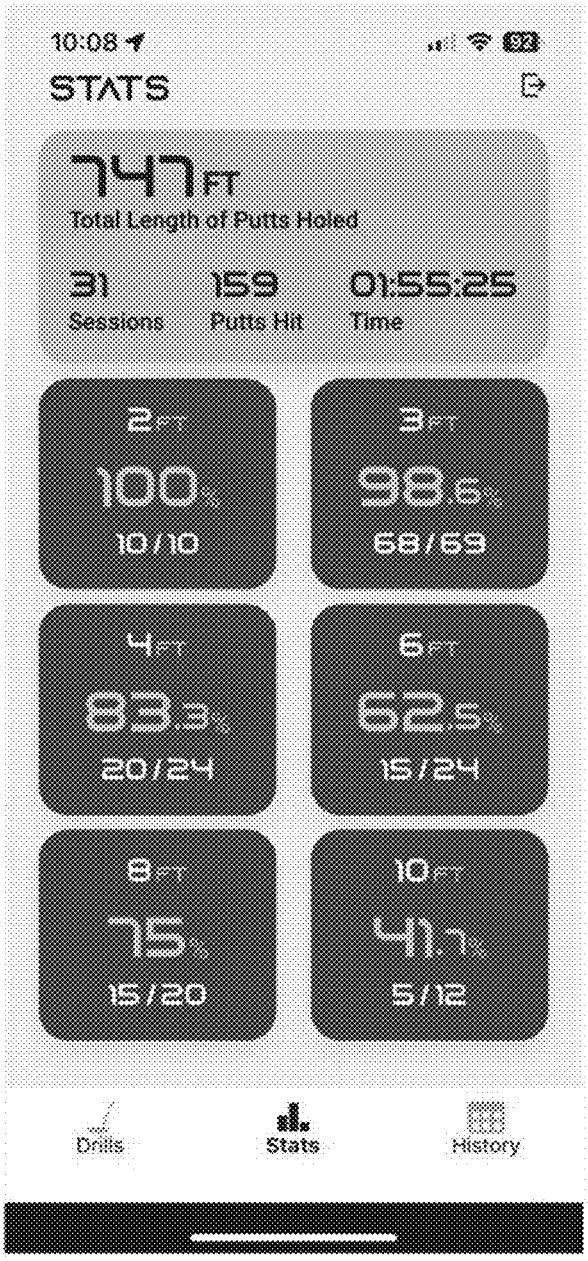

In some examples illustrated in FIG. 4 is an overhead view of putting green 76 utilizing multiple hubs 50. As shown, each hub 50 employs one or more antennas (including one or more antennas arranged in flag). In some examples, one or more of the hubs 50 are configured to transmit/receive signals 74 from one or more of the other hubs 50 and/or the sports object 70. Based on the information from the sports object, physical features of the putting green 76 can be measured and recorded, which can be used to build a digital, topographical map of the area. In instances where the topographical map has been previously generated, movement of the sports object can indicate coordinates of the sports object on the putting green. Additionally or alternatively, movement of the sports object can be used to monitor performance of a putt, including force, distance, speed, acceleration, trajectory, elevation and/or changes in elevation, as a list of non-limiting examples. The measurements and/or information can be used to prepare statistics for a particular player, course, shot, and/or hole, as explained further with respect to FIGS. 6A and 6B.

Figure 5:
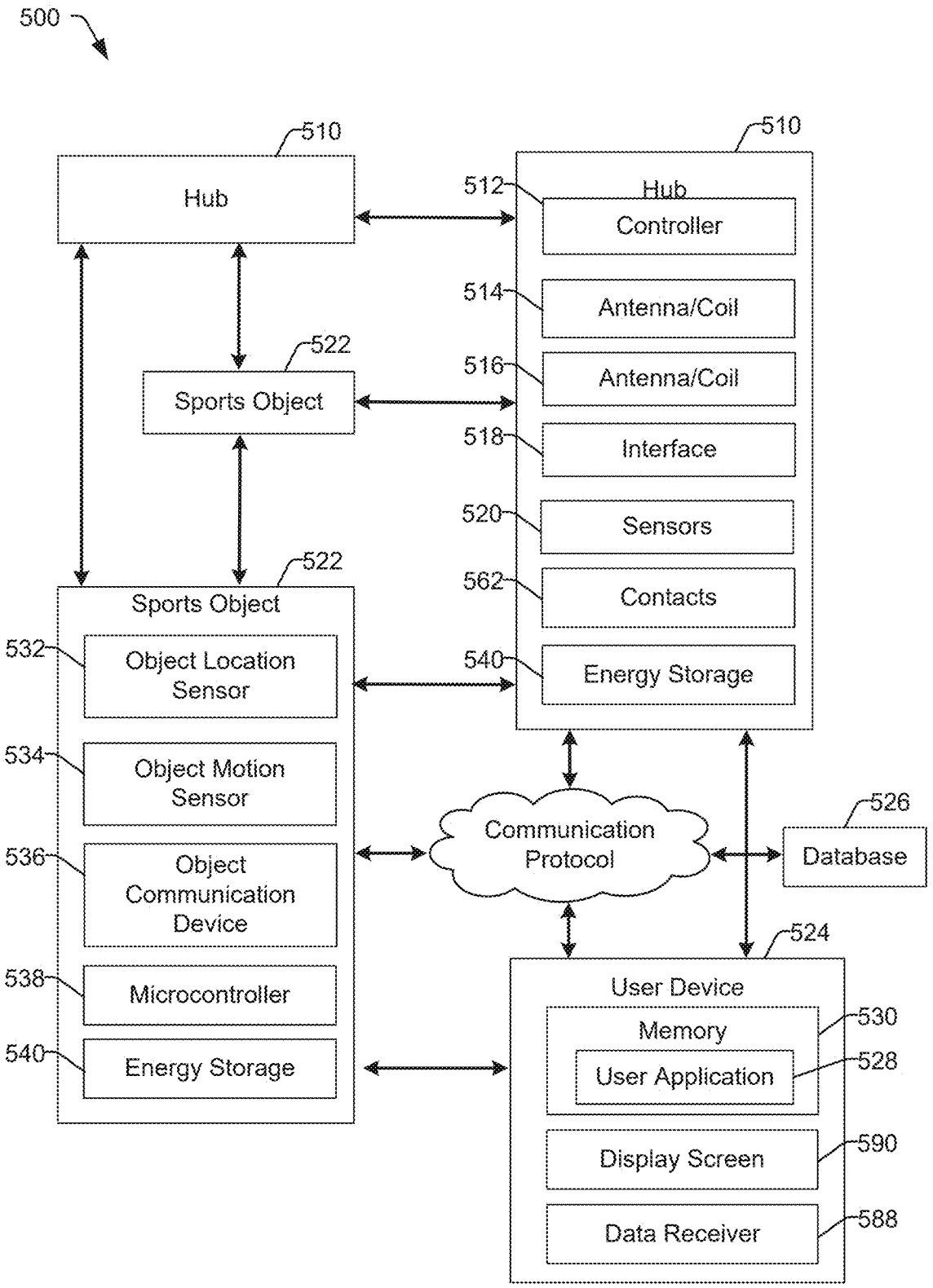
FIG. 5 illustrates a schematic view of an exemplary real-time tracking system for an exemplary hub communicating with a spots object or other hubs, in accordance with aspects of this disclosure.

Turning now to FIG. 5, there is shown a simplified schematic view of an exemplary real-time tracking system 500 for an exemplary hub 10 communicating with a spots object or other hub, as disclosed herein. The system 500 provides one or more hubs 510 (e.g., hub 10, 50), sports object 522 (e.g., sports object 70) and a user device 524 (e.g., a smart phone, computer, wearable device, etc.) in selective communication with the sports object 522. In some examples, a database 526 is in communication (either locally or remotely) with the user device 524 and configured for selectively storing data related to the sports object 522 and the associated user device 524. In some examples, the user device 524 and database 526 are one and the same—as such, it is intended that those terms as used herein are to be interchangeable with one another.

The hub 510 can include one or more antennas or coils 516 and 518 in electrical communication with a controller 512, which can include the components disclosed herein, such as arranged on a printed circuit board. The hub 510 further includes one or more interfaces 518 (e.g., user interfaces, visual, haptic, audible, etc.-such as indicator 28). In some examples, contact 562 (e.g., a port 13, contact 62, and/or other power/data interface) can be included. However, as disclosed herein, the hub is configured to provide for data and power signals to be transmitted and/or received wirelessly. An energy storage device 540 can be included for powering components to communicate with the other devices, and/or for charging a sports object when docked with the hub.

In some examples, the user device 524 and database 526 are omitted, such that the system 500 and associated methods described herein are implemented solely through the sports object 522—thus, any methods or functionality described herein as being carried out by the user device 524 or database 526 may also be carried out by the sports object 522.

While examples of the system 500 and associated methods are discussed in the context of golf for illustrative purposes, the disclosed concepts are not so limited. Rather, the system 500 and associated methods may be incorporated into any other type of sports objects now known or later developed. For instance, the term "sports object" includes any object that is used in various sports-related activities, such as golf balls, soccer balls, basketballs, baseballs, footballs, tennis balls, lacrosse ball, cricket ball, hockey pucks, and flying discs, as a list of non-limiting examples.

Communication between each of the hub 510, the sports object 522, the user device 524, and the database 526 may be achieved using any wired- or wireless-based communication protocol (or combination of protocols) now known or later developed. As such, the disclosed concepts should not be limited to any one particular type of communication protocol, even though certain exemplary protocols may be mentioned herein for illustrative purposes. The term "user device" is intended to include any type of computing or electronic device, now known or later developed, capable of communicating with the sports object 522—such as desktop computers, mobile phones, smartphones, laptop computers, tablet computers, personal data assistants, gaming devices, wearable devices, etc. As such, the system 500 should not be limited to use with any one particular type of computing or electronic device, even though certain exemplary devices may be mentioned or shown herein for illustrative purposes.

With continued reference to FIG. 5, each of the hub 510, the sports object 522, user device 524, and database 526 contains the hardware and/or software necessary to carry out the exemplary methods for monitoring and tracking various attributes associated with the movement of the sports object 522, as described herein. Furthermore, the user device 524 comprises a plurality of computing devices selectively working in concert with one another to carry out the exemplary methods for monitoring and tracking various attributes associated with the movement of the sports object 522, as disclosed herein.

Figure 6C:
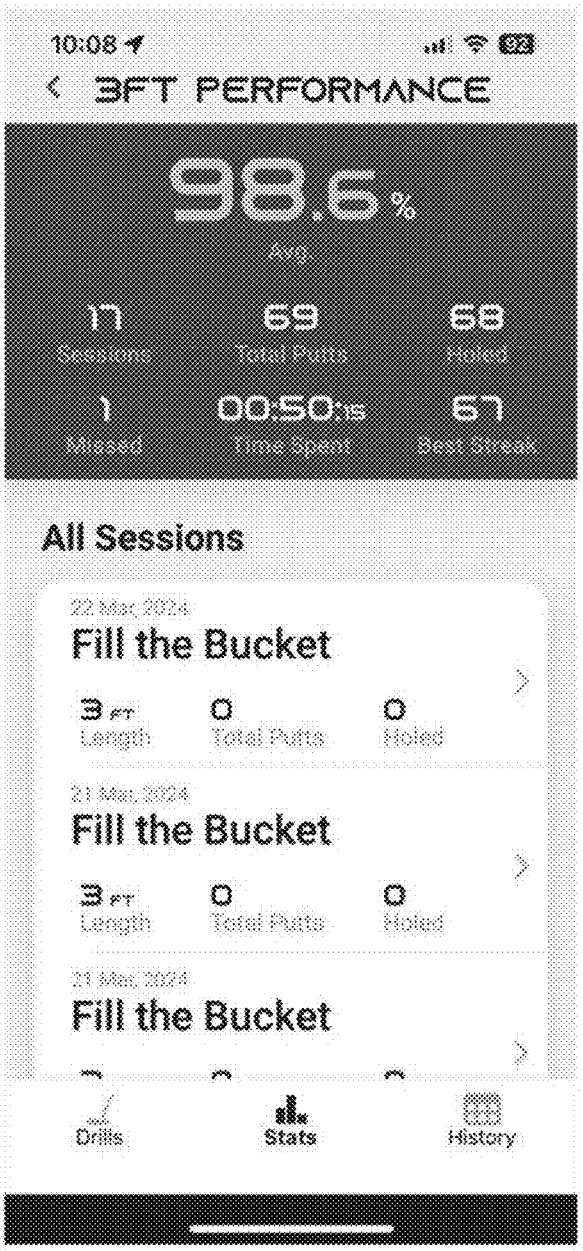

The user device 524 provides a user application 528 residing locally in memory 530 on the user device 524, the user application 528 being configured for selectively communicating with the hub 510 and/or the sports object 522. The term "memory" is intended to include any type of electronic storage medium (or combination of storage mediums) now known or later developed, such as local hard drives, RAM, flash memory, secure digital ("SD") cards, external storage devices, network or cloud storage devices, integrated circuits, etc. In some examples, the user device 524 is in the possession (or otherwise under the control) of a user who is desirous of utilizing the system 500 for monitoring and tracking various attributes associated with the movement of the sports object 522. Example illustrations of a display of play as recorded and presented by the user device 524 are provided in FIGS. 6A through 6C.

In some examples, the sports object 522 provides one or more object location sensor 532 configured for determining at least one of a current latitude, longitude and altitude of the sports object 522. As disclosed herein, the object location sensor 532 can be any type of movement or positioning sensor. One or more object motion sensors 534 are configured for determining at least one motion attribute of the sports object 522. For instance, the object motion sensor 534 can be a gyroscope, accelerometer, magnetometer, temperature sensor, UWB RF Signal time of flight (TOF) sensor/determination, BT enabled Angular Rate of arrival sensor/determination or Received Signal Strength Indicator (RSSI), etc. The information from sensors of the sports object 522 can be received at the hub 510 and processed, and/or transmitted to the user device 524 and/or the database 526.

The sports object 522 further provides an object communication device 536 configured for selectively communicating with the user device 524. For example, the object communication device 536 can be any suitable wired or wireless enabled device, such as BT, cellular, Wi-Fi, LORA, or long range FM for example. In some examples, the sports object 522 further provides a microcontroller 538 in electrical communication with each of the object location sensor 532, object motion sensor 534, and object communication device 536, the microcontroller 538 configured for controlling each of the respective components and for facilitating communication of data therebetween. For example, each of the object location sensor 532, object motion sensor 534, and object communication device 536, the microcontroller 538 can be arranged on a single PCB, such as PCB 20.

In at least one example, a battery 540 (e.g., energy storage device 24) is configured for selectively providing power to each of the object location sensor 532, object motion sensor 534, object communication device 536, and microcontroller 538.

In some examples, the user device 524 and/or the database 526 are configured to store and/or manage flight data containing various details related to the sports object 522, preferably each time the sports object 522 is put into motion (i.e., thrown, hit, kicked, etc.). In some examples, the flight data includes (but is not limited to) at least one of a unique object identifier (such as an alphanumeric name, for example), a start location value containing the geographic coordinates of the sports object 522 prior to being put into motion, an end location value containing the geographic coordinates of the sports object 522 after subsequently coming to rest, an altitude value containing the altitude reached by the sports object 522 while in motion, a flight path value containing details related to the flight path of the sports object 522 while in motion, a launch trajectory value containing details related to the launch trajectory of the sports object 522 as it was put into motion, a speed value containing the speed reached by the sports object 522 while in motion, a spin rate value containing the spin rate of the sports object 522 while in motion, a travel distance value containing the distance between the start location and end location values, a distance to goal value containing the distance between the sports object 522 and the location toward which the sports object 522 is being moved (i.e., goal, hoop, hole, basket, etc.), a timestamp value containing at least one of a date and time at which the associated shot data is collected (i.e., the timestamp associated with the particular throw/hit/kick/etc. of the sports object 522), an environmental conditions table containing details related to select environmental conditions in which the sports object 522 is being used (i.e., weather conditions, playing field conditions, etc.), a club used value containing details related to the particular golf club used to hit the sports object 522 (where the sports object 522 is a golf ball), and a swing count value containing details related to the particular swing/stroke number associated with the current sports object 522 hit (again, where the sports object 522 is a golf ball).

Methods and processes of collecting information are provided in U.S. patent application Ser. No. 17/971,761, entitled "Systems and Methods for Tracking a Sports Objects", and U.S. patent application Ser. No. 15/863,795, entitled "Real-Time Tracking System for Sports Scoring Objects and Methods of Use", which is herein incorporated by reference in its entirety.

Referring again to FIG. 5, in some examples, the user device 524 provides a data receiver 588 configured for receiving the selectively transmitted data from the object communication device 536 of the sports object 522. Additionally, in an example, the user device 524 provides an at least one display screen 590 configured for displaying the sports object 522 data in real-time. In an example, the display screen 590 is a touchscreen.

Figure 7A:
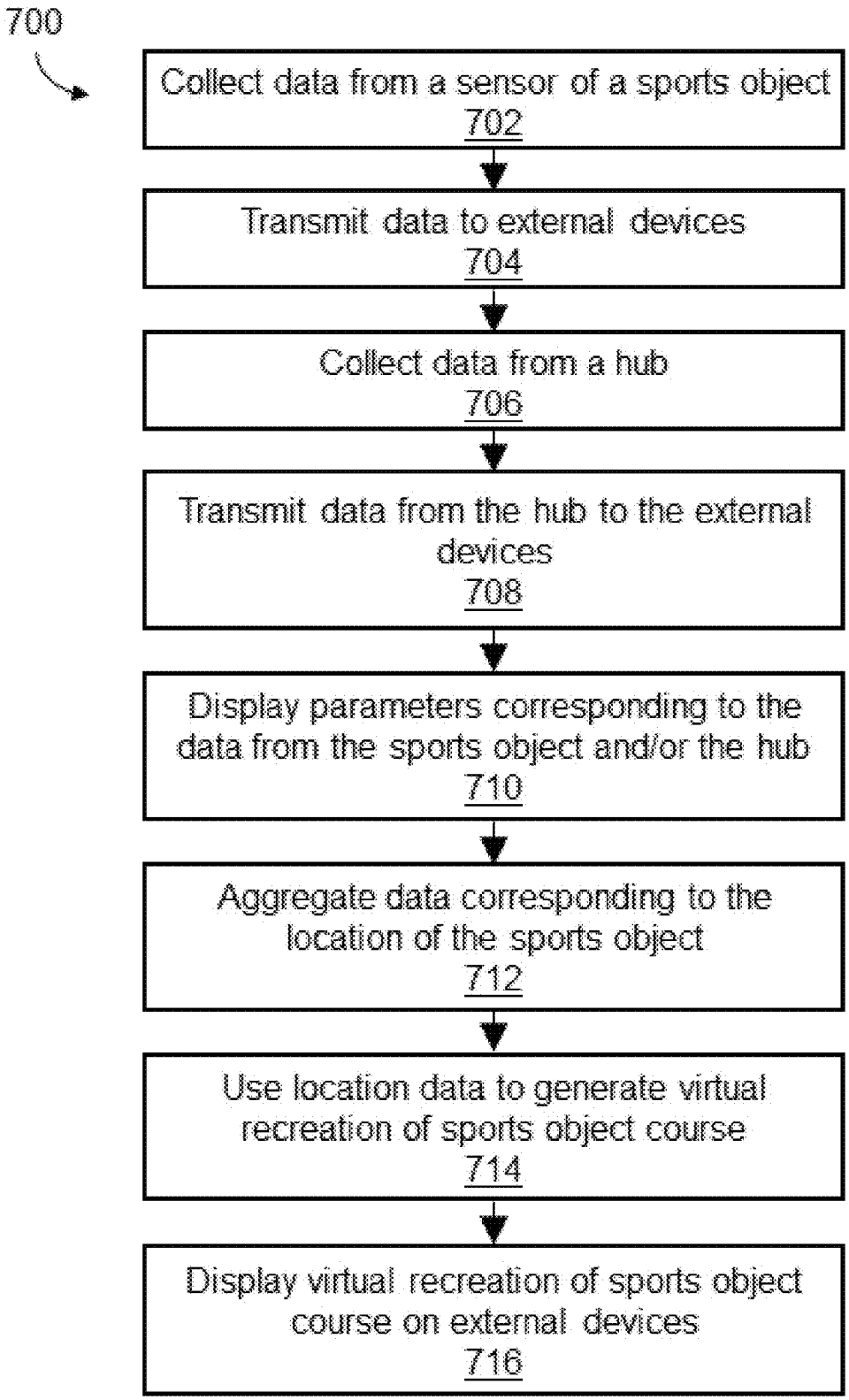
FIGS. 7A and 7B are examples method for collecting and displaying data corresponding to a sports object, in accordance with aspects of this disclosure.
Figure 7B:
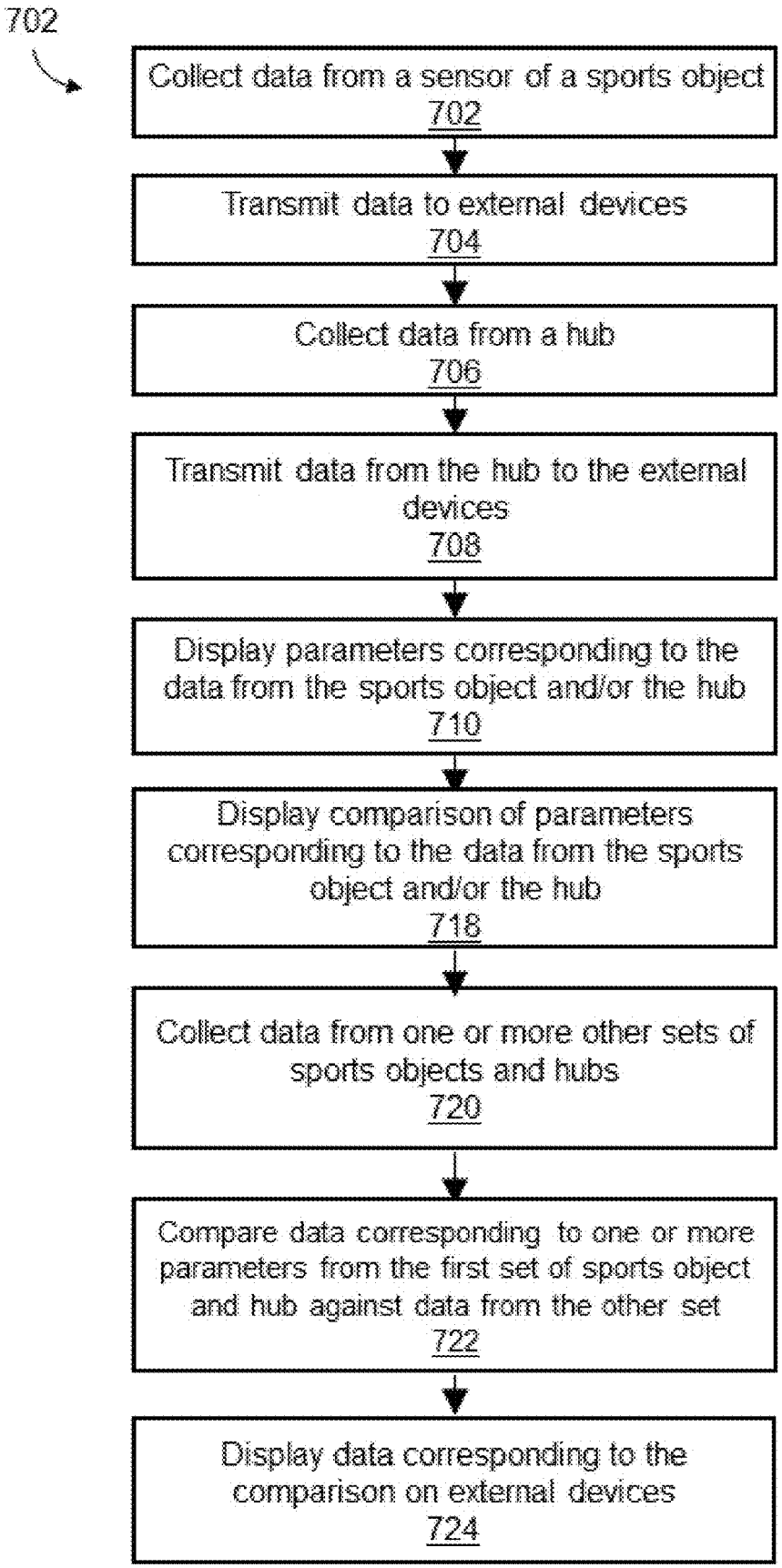

Turning to FIGS. 7A and 7B, an example method 700 is provided for collecting and displaying data corresponding to a sports object (e.g., a ball 70). FIG. 7A provides an example method for collecting and displaying data corresponding to a sports object, including generating and displaying a virtual recreation of a sports object course on external devices 516. In another embodiment, provided in FIGS. 7B, data corresponding to a sports object may be collected and compared against data corresponding to another sports object. The method may utilize the hub and sports object described with respect to FIGS. 1A to 6B.

As shown in block 702 of FIGS. 7A and 7B, one or more sensors of a sports object (e.g., sensors 532, 534), collects data corresponding to one or more parameters corresponding to a position or status of the sports object. For example, the sensor may include one or more force sensors configured to track a specific force or acceleration corresponding to a "hit" on the sports object. In this example, the sports object is configured to track the number of "hits" it receives in accordance with an embodiment disclosed herein. In another embodiment, a hub (e.g., hub 510) may communicate directly with one or more other hubs and/or one or more sports objects (e.g., sports object 522). In such examples, one or both of the hubs and/or sports objects may store the data to be transferred to external devices (e.g., user devices 524 or a database 526) at a later time. The data stored in the sports object and/or hubs may be transmitted to external devices via a physical connection to the sports object and/or hubs (e.g., via a physical connection through port 13).

In other embodiments, the external devices may transmit the data received from the sports object to another external device (e.g., a database 526, such as located in a cloud computing environment). In another example, the sports object (e.g., sports object 522), and/or the hub (e.g., hub 510) may transmit data directly to the other external device (e.g., a database 526). In those cases, the sports object and/or the hub may transmit data directly to an external database, and said data may be transmitted from the database to another external device (e.g., user devices 524).

As shown in block 704 of FIGS. 7A and 7B, the sports object transmits the data it collects to external devices (e.g., user devices 524). In some embodiments, the data may be aggregated or stored on the external devices.

As shown in block 706 of FIGS. 7A and 7B, one or more sensors in the hub (e.g., sensors 520) also collects data corresponding to one or more parameters corresponding to the sports object. For instance, in one embodiment, the sensors in the hub, may be configured to track each time the hub makes contact with the sports object. In this example, the hub may be configured to track the number of times the sports object makes a "hole."

In other examples, the hub may be configured to collect and transmit data corresponding to the location of the sports object, as described with respect to FIGS. 1A to 6C herein. In such examples, multiple hubs may be configured to track location data of a sports object by acting in a mesh network.

Once the hub has collected data, the data is then transmitted to external devices, as shown in block 708 of FIGS. 7A and 7B. As with block 704, in some embodiments, the data may be aggregated or stored on the external devices. In another embodiment, the external devices may later transmit the data received from the sports object to another external device (e.g., a cloud).

Once the external devices have received data from the sports object (block 704) and the hub (block 708), external devices (e.g., external devices 524), display parameters corresponding to the data from one or both the sports object and hub, as shown in block 710 of FIGS. 7A and 7B. For example, this display may take the form of an application on a cell phone. In such examples, the parameters (e.g., golf swings, batting connections, etc.) may correspond to the number of "hits" on the sports object before making contact with the hub.

In one embodiment, as shown in FIG. 7A, one or both of the sports object and hub collects data corresponding to the location and change in location of the sports object, as shown in block 712. In such an embodiment, data corresponding to the location of the sports object may be tracked via sensors (e.g., sensors 520, 532, 534) inside the sports object or the hub. The data corresponding to the location is transmitted to the external devices, as described with respect to blocks 704 and 708.

In the same embodiment, as shown in block 714, the external devices use the data corresponding to the location of the sports object to generate a virtual recreation of a sports object course. For example, numerous data points corresponding to location of the sports object can be collected (in accordance with block 712), to generate a virtual recreation of the sports object course.

Once a virtual recreation of a sports object course is generated, it is displayed on external devices, as shown in block 716. For example, the virtual recreation displayed may be a three-dimensional "map" of the layout of the sports object course, including inclines. In another example, the virtual recreation displayed may be a two-dimensional "top-down" view of the layout of the sports object course. In such examples, the virtual recreation may still depict incline information according to accepted standards of showing inclines as in a map.

In another example method 702, shown in FIG. 7B, external devices compare and display data corresponding to one or more parameters of the sports object or hub against prior measured data, as shown in block 718. In such an embodiment, the data displayed may correspond, for example, to: average number of "hits" to get the sports object make contact with the hub; changes in number of "hits" on the sports object between uses; average distance traveled of the sports object; or minimum/maximum number of "hits" to get the sports object to make contact with the hub.

In accordance with the same embodiment, external devices collect data from one or more other sets of sports object and hub, as shown in block 720. In such examples, the data is collected from the one or more other sets of sports object and hub in accordance with this disclosure, then transmitted to external devices. For example, a single external device may collect data from multiple sets of sports object and hub.

In block 722, the external devices compare the data collected from the other sets of sports object and hub with data from the original set of sports object and hub. One or more parameters corresponding to performance of the sports object and hub are compared against the same parameters as collected by the one or more other sets of sports object and hub. For example, parameters described with respect to block 118 may be compared between sets of sports object and hub.

In block 724, the comparison data generated with respect to block 722 is displayed on external devices. The data compared between multiple sets of sports object and hubs may, for example, be the same as the data compared for one set of sports object, as described with respect to block 718.

A system for real-time tracking of a sports objects and associated methods of use are disclosed and configured for monitoring and tracking various attributes associated with the movement of sports objects, such as from a stationary smart hub. Because the principles of the disclosed subject matter may be practiced in a number of configurations and/or applications beyond those shown and described, it is to be understood that the disclosure is not in any way limited by the provided examples, but is generally directed to a real-time tracking system within a hub for sports objects, both of which are able to take numerous forms to do so without departing from the spirit and scope of the disclosed examples. One skilled in the art would appreciate the disclosed subject matter is not limited to the particular sizes, geometries, and materials of construction disclosed, but may instead entail other functionally comparable structures or materials, now known or later developed, without departing from the spirit and scope of this disclosure.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the disclosure are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an example or aspect of an example also carries with it the alternative meaning of "may not" or "cannot." As such, if the present specification discloses that an example or an aspect of an example may be or can be included as part of the inventive subject matter, then the negative limitation or exclusionary proviso is also explicitly meant, meaning that an example or an aspect of an example may not be or cannot be included as part of the inventive subject matter. In a similar manner, use of the term "optionally" in reference to an example or aspect of an example means that such example or aspect of the example may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present disclosure (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present disclosure and does not pose a limitation on the scope of the disclosure otherwise claimed. No language in the present specification should be construed as indicating any non-claimed element essential to the practice of the disclosure.

When used in the claims, whether as filed or added per amendment, the open-ended transitional term "comprising" (along with equivalent open-ended transitional phrases thereof such as "including," "containing" and "having") encompasses all the expressly recited elements, limitations, steps and/or features alone or in combination with un-recited subject matter; the named elements, limitations and/or features are essential, but other unnamed elements, limitations and/or features may be added and still form a construct within the scope of the claim. Specific examples disclosed herein may be further limited in the claims using the closed-ended transitional phrases "consisting of" or "consisting essentially of" in lieu of or as an amendment for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim, whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (along with equivalent open-ended transitional phrases thereof) includes within its meaning, as a limiting case, claimed subject matter specified by the closed-ended transitional phrases "consisting of" or "consisting essentially of." As such, examples described herein or so claimed with the phrase "comprising" are expressly or inherently unambiguously described, enabled and supported herein for the phrases "consisting essentially of" and "consisting of."

All patents, patent publications, and other publications referenced and identified in the present specification are individually and expressly incorporated herein by reference in their entirety for the purpose of describing and disclosing, for example, the compositions and methodologies described in such publications that might be used in connection with the present disclosure. These publications are provided solely for their disclosure prior to the filing date of the present application. Nothing in this regard should be construed as an admission that the inventors are not entitled to antedate such disclosure by virtue of prior disclosure or for any other reason. All statements as to the date or representation as to the contents of these documents is based on the information available to the applicants and does not constitute any admission as to the correctness of the dates or contents of these documents.

It should be understood that the logic code, programs, modules, processes, methods, and the order in which the respective elements of each method are performed are purely exemplary. Depending on the implementation, they may be performed in any order or in parallel, unless indicated otherwise in the present disclosure. Further, the logic code is not related, or limited to any particular programming language, and may comprise one or more modules that execute on one or more processors in a distributed, non-distributed, or multiprocessing environment.

The methods described above may be used in the fabrication of integrated circuit chips. The resulting integrated circuit chips can be distributed by the fabricator in raw wafer form (that is, as a single wafer that has multiple unpackaged chips), as a bare die, or in a packaged form. In the latter case, the chip is mounted in a single chip package (such as a plastic carrier, with leads that are affixed to a motherboard or other higher level carrier) or in a multi-chip package (such as a ceramic carrier that has either or both surface interconnections or buried interconnections). In any case, the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

While aspects of the disclosure have been described with reference to at least one exemplary example, it is to be clearly understood by those skilled in the art that the disclosure is not limited thereto. Rather, the scope of the disclosure is to be interpreted only in conjunction with the appended claims and it is made clear, here, that the inventor (s) believe that the claimed subject matter is the disclosure.

What is claimed is:

1. A system for tracking a sports object comprising:

a hub configured to receive a sports object, the hub including:

one or more hub sensors configured to track parameters or conditions corresponding to the sports object, wherein the one or more hub sensors are configured to track when the sports object makes physical contact with the hub, and communications circuitry configured to transmit information to and receive information from the sports object and from one or more external devices arranged remote from the hub and the sports object.

2. The system of claim 1, further comprising a sports object that includes object sensors configured to track one or more parameters corresponding to the sports object, and control and communications circuitry configured to transmit information to and receive information from one or more of the external devices and the hub.

3. The system of claim 2, wherein one of the object sensors is a force sensor or a spin sensor.

4. The system of claim 3, wherein the force sensor is configured to track a specific force or acceleration applied to the sports object, wherein the specific force or acceleration applied to the sports object corresponds to a hit on the sports object.

5. The system of claim 4, the sports object is configured to transmit to one or more of the external devices and the hub when a hit on the sports object registers on the force sensor.

6. The system of claim 5, wherein the one or more external devices are configured to track the number of hits on the sports object between a starting time and the sports object making physical contact with the hub.

7. The system of claim 2, wherein one of the object sensors is a position or direction sensor configured to track a distance traveled by the sports object.

8. A system for tracking a sports object comprising:

a hub configured to receive a sports object, the hub including:

a housing configured to removably receive the sports object, the housing having an outer circumference and external height such that the housing fits inside a regulation-sized golf hole; and one or more hub sensors located in the housing and configured to track parameters or conditions corresponding to the sports object, wherein the one or more hub sensors are configured to track when the sports object makes physical contact with the hub, and communications circuitry located in the housing and configured to transmit information to and receive information from the sports object and from one or more external devices arranged remote from the hub and the sports object.

9. The system of claim 8, further comprising one or more antennas, the one or more antennas configured to receive information from and transmit information to the one or more external devices, or the sports object wherein the antennas include two or more removable antennas configured to communicate with each other in a mesh network.

10. The system of claim 9, wherein the mesh network is configured to track one or more parameters corresponding to the sports object.

11. The system of claim 10, wherein the one or more parameters include velocity, force, acceleration, spin, direction, or position of the sports object.

12. The system of claim 11, wherein the mesh network is configured to track a specific force or acceleration applied to the sports object, wherein the specific force or acceleration applied to the sports object corresponds to a hit on the sports object.

13. The system of claim 12, wherein the mesh network is configured to track the number of hits on the sports object between a starting time and the sports object making physical contact with the hub.

14. The system of claim 11, wherein the mesh network is configured to track a spin of, direction of, or distance traveled by the sports object before making physical contact with the hub.

15. The system of claim 8, wherein the hub includes a cradle configured to removably receive the sports object.

16. The system of claim 15, wherein the cradle includes a coil configured to wirelessly charge the sports object when arranged within the cradle.

17. A method of collecting and displaying data corresponding to a sports object, the method comprising:

collecting data from one or more sensors of a sports object, the data corresponding to one or more parameters corresponding to a position or status of the sports object, wherein the one or more parameters includes a value corresponding to a specific force or acceleration applied to the sports object, wherein the specific force or acceleration applied to the sports object corresponds to a hit on the sports object;

transmitting the data from the sports object to one or more devices external to the sports object;

collecting data from a power hub configured to track one or more parameters corresponding to the sports object, and having circuitry configured to transmit information to and receive information from the one or more devices external to the sports object, wherein the data from the power hub includes data corresponding to the moment the sports object makes physical contact with the power hub;

transmitting the data from the power hub to the one or more devices external to the sports object; and displaying one or more parameters corresponding to the data from the sports object or the data from the power hub on the one or more devices external to the sports object, wherein the parameters include the number of hits between a starting time and the sports object making physical contact with the power hub.

18. The method of claim 17, the method further comprising:

determining a path along which the sports object moves, transmitting data corresponding to the path along which the sports object moves to the one or more devices external to the sports object, aggregating the data corresponding to the path along which the sports object moves, using the aggregated data corresponding to the path along which the sports object moves to virtually recreate a sports object course, displaying a virtual recreation of the terrain on which the sports object moves on the devices external to the sports object, and comparing the data corresponding to the path along which the sports object moves to other sports objects moving on the same virtual recreation of the sports object course, wherein the virtual recreation is displayed in two or three dimensions.

19. The method of claim 18, the method further comprising:

configuring the virtual recreation by displaying a route along the terrain on which the sports object is instructed to move.

20. The method of claim 19, wherein the virtual recreation depicts incline information.

21. The method of claim 17, the method further comprising:

collecting data corresponding to the same one or more parameters from one or more other sets of sports objects and power hubs;

comparing the data corresponding to the one or more parameters from one set of sports objects and power hubs to the data corresponding to the one or more parameters from the one or more other sets of sports objects and power hubs; and displaying the data corresponding to the comparison on the devices external to the sports objects.

22. A method of collecting and displaying data corresponding to a sports object, the method comprising:

collecting data from one or more sensors of a sports object, the data corresponding to one or more parameters corresponding to a position or status of the sports object, wherein the one or more parameters includes a value corresponding to a specific force or acceleration applied to the sports object, wherein the specific force or acceleration applied to the sports object corresponds to a hit on the sports object;

wherein the data includes data corresponding to the moment the sports object stops moving;

transmitting the data from the sports object to one or more devices external to the sports object;

displaying one or more parameters corresponding to the data from the sports object on the one or more devices external to the sports object, wherein the parameters include the number of hits experienced by the sports object;

determining a path along which the sports object moves;

transmitting data corresponding to the path along which the sports object moves to the one or more devices external to the sports object;

aggregating the data corresponding to the path along which the sports object moves;

using the aggregated data corresponding to the path along which the sports object moves to virtually recreate a sports object course;

displaying a virtual recreation of the terrain on which the sports object moves on the devices external to the sports object; and comparing the data corresponding to the path along which the sports object moves to other sports objects moving on the same virtual recreation of the sports object course, wherein the virtual recreation is displayed in two or three dimensions.

23. The method of claim 22, the method further comprising:

configuring the virtual recreation by displaying a route along the terrain on which the sports object is instructed to move.

24. The method of claim 22, wherein the virtual recreation depicts incline information.

25. The method of claim 22, the method further comprising:

collecting data corresponding to the same one or more parameters from one or more other sets of sports objects;

comparing the data corresponding to the one or more parameters from one set of sports objects to the data corresponding to the one or more parameters from the one or more other sets of sports objects; and displaying the data corresponding to the comparison on the devices external to the sports objects.

* * * * *